United States Patent [19]

Platt

[11] 4,090,425

[45] May 23, 1978

[54] WIRE COILING MACHINE FLUID CUTOFF

[75] Inventor: Stephen A. Platt, Grand Haven, Mich.

[73] Assignee: S. A. Platt, Inc., Grand Haven, Mich.

[21] Appl. No.: 783,945

[22] Filed: Apr. 1, 1977

[51] Int. Cl.[2] ..... B26D 7/06; B21F 11/00

[52] U.S. Cl. ..... 83/402; 83/907; 72/132; 140/92.7

[58] Field of Search ..... 83/402, 403, 907; 140/92.3, 92.7; 72/132

[56] References Cited

U.S. PATENT DOCUMENTS

| | | | |
|---|---|---|---|
| 2,846,004 | 8/1958 | Fotland | 83/402 X |
| 2,869,640 | 1/1959 | Platt | 83/907 X |
| 3,186,272 | 6/1965 | Kaufmann | 83/907 X |
| 3,370,495 | 2/1968 | Platt | 83/907 X |
| 3,838,617 | 10/1974 | Felker | 83/907 X |

*Primary Examiner*—Willie G. Abercrombie

*Attorney, Agent, or Firm*—Price, Heneveld, Huizenga & Cooper

[57] ABSTRACT

Wire coil cutoff apparatus for a wire coiling machine that forms an axially advancing, rotational, helical wire coil, the advancing coil being momentarily biased into indexing engagement with the cutter blade by pneumatic pressure, and the indexed blade then being shifted into cutoff relation with the coil while the pressure is still applied.

10 Claims, 12 Drawing Figures

WIRE COILING MACHINE FLUID CUTOFF

BACKGROUND OF THE INVENTION

This invention relates to cutoff mechanism for a wire coiling machine.

Coiling machines employed to continuously form fine wire into wire coil, as for electrical resistance elements, typically have employed a flying cutter blade to repeatedly sever segments from the forming coil. Although these have been in various forms, basically the concept involved was to first shift the cutting edge into light engagement with the coil turns for indexing, and then further shifting the blade to sever the indexed coil segment. In performing this operation, a key factor was to minimize damage to the coil and achieve a clean cut with minimal cross sectional area on the severed ends of the wire.

Several years ago, the inventor herein developed an improved cutoff mechanism which allowed the cutter to mechanically index with a lightly powered shift of the blade against the coil at the face of the die, followed by wire cutoff with a highly powered further shift of the blade across the coil. This apparatus, set forth in U.S. Pat. No. 3,370,495, performed considerably better than prior devices, such that the sensitive index allowed cleaner cutoff in many instances.

In modern production practice, however, the nature of the coil diameter, the wire diameter, and the coiling speeds employed are such that the complexities caused by attempting to index the wire with known apparatus, even that in the above noted patent, are too great. The indexing mechanism sometimes does not meet and usually does not hold the required sensitivity, causing a constant problem for maintenance personnel. If the pressure is not quite enough, proper indexing is not achieved. If the blade, in its indexing shift, moves even 0.001 or 0.002 of an inch too much, too much pressure is brought to bear on the delicate, fast-moving coil which is pushed against the side of the die opposite the blade, causing the coil to slow down and swell at this area, thereby rendering the coil useless. It is also desirable to attain and maintain accurate and sensitive indexing for only a very short time interval of blade engagement with the coil. If the blade is retained in indexing engagement for longer time intervals, the rotational speed of the spinning coil is retarded at the blade and die, again causing the coil diameter in this area to swell, thereby rendering the coil useless for uniform electrical resistance as in appliances. I.e., the coil portion is then scrap.

Since maintenance personnel are often unable to maintain necessary cutter index sensitivity, the prevailing practice is to forego attempts to index altogether. Instead, the machine is set to simply chop off the wire without indexing, hoping that the wire will be clean-cut. This, however, requires subsequent visual inspection of the individual coil ends, and hand nipping of many of them to a clean-cut condition.

To fully realize the problem the industry has in obtaining clean-cut coil ends, it should be understood that well over half of all production is so-called close or tight coiled, which is the most difficult form for accurate indexing and clean cutting. One technique which is employed to assist in this operation is to cause the cutter die to be made with the hole through the die at the same angle as the index angle of the coil turns, so that the cutter blade "sees" the coil as nearly parallel turns of wire. This improves the odds of the blade entering the coil between turns, to cause a cleaner cut. However, the results are still far from satisfactory and require subsequent visual inspection and manual trimming of the individual segments.

SUMMARY OF THE INVENTION

This invention provides novel indexing and cutting for the spinning wire coil being formed. The cutter is not shifted to the coil for indexing. Rather, the coil is specially pneumatically shifted momentarily to the cutter blade by the application of a pneumatic pressure differential across the coil, preferably from an air jet directed against the opposite side of the coil from the blade. This lightly retains the coil screwing past the blade edge for a very short index time, e.g. about two tenths of a second. The blade is then shifted in the opposite direction, i.e. toward the air jet, to cut the indexed coil segment clean, with the air jet continuing to maintain the coil against the blade during this blade shifting and cutting operation.

It has been determined through repeat experimentation that there are no critical adjustments to be set or maintained using this invention. Further, there is no coil swelling or slowing at the blade and die area when employing this air indexing, and air assist cutoff. The coil is not forced into engagement with the side of the die during indexing.

The die for the unit can be and preferably is specially cone-shaped inside so that the entire cutter can be conveniently rotated to match any coil helix angle while the coil continues to travel horizontally. It is no longer necessary to know the exact actual helix angle of the coil since the operator can simply rotate the entire cutter in one direction until the flat cutting face of the cone die is visually aligned with the wire turns on the front side of the coil, and then, after this angle is noted, the die is rotated this same amount past center in the opposite direction, aligning the blade with the wire turns on the rear side of the coil.

The invention enables high speed, sensitive, accurate, momentary indexing of continuously formed helical coils, with minimal set up efforts, achieving dependable operation.

These and other features, objects, and advantages of the apparatus will be readily apparent from a review of the detailed description hereinafter, in conjunction with the drawings.

DESCRIPTION OF THE PREFERRED EMBODIMENT

Figure 2:
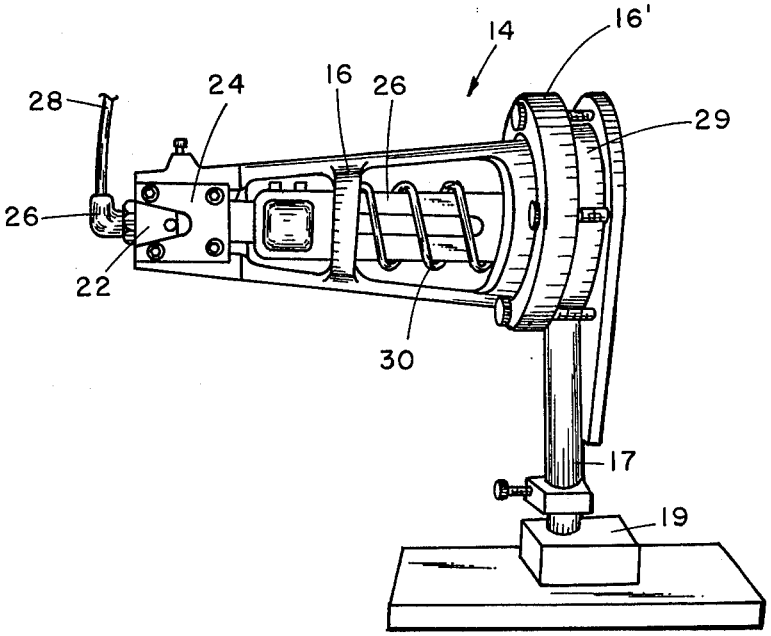
FIG. 2 is an elevational view of the novel apparatus as viewed from the right side of FIG. 1.

Referring now specifically to the drawings, the complete assembly 10 there depicted includes a wire coiling machine 12 of which only a minor portion is depicted and which may be of the type for example set forth in U.S. Pat. No. 3,401,557, entitled *WIRE COILING MACHINE,* issued Sept. 17, 1968 to the inventor herein, and the disclosure of which is incorporated by reference herein. Alternatively, a machine such as that in U.S. Pat. No. 3,082,810 may be employed, for example. Mounted on the discharge end of this wire coiling machine so as to act upon a continuously produced, spinning, helical wire coil advancing axially from the coiling machine is the novel wire coil cutoff apparatus 14 for severing the advancing wire coil into predetermined length segments.

This cutoff apparatus 14 includes a main support housing 16 adapted to be mounted adjacent the discharge end of the wire coiling machine 12, the long dimension of this housing being generally transverse to the axis of the spinning wire coil C emitted from the wire coiling machine. Housing 16 is supported in cantilever fashion by having one annular end flange retained within a mounting bearing ring 16'. Ring 16' is attached by fasteners 21 to a back plate 23 which is supported on a vertical pivot column 17 pivotally supported on a bearing block device 19. This pivotal arrangement allows the cutoff die to advance a limited amount with the coil, as set forth more specifically hereinafter. Housing 16 supports a die 18 on the opposite end from the pivot column. The die has a frusto conically-shaped through passage 20 with a larger diameter inlet and a smaller diameter outlet. The outlet is at a face 18' of the die across which a transversely shiftable cutoff knife or blade 22 moves. Blade 22 is shiftable from a first position with its edge just protruding into the die opening in chordal arrangement, across the outlet opening 20' for severing the wire coil C.

Figure 3:
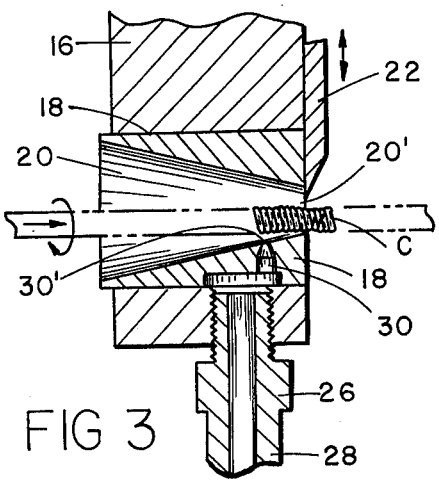
FIG. 3 is a fragmentary sectional view of the apparatus in FIG. 4, taken on plane III—III.
Figure 4:
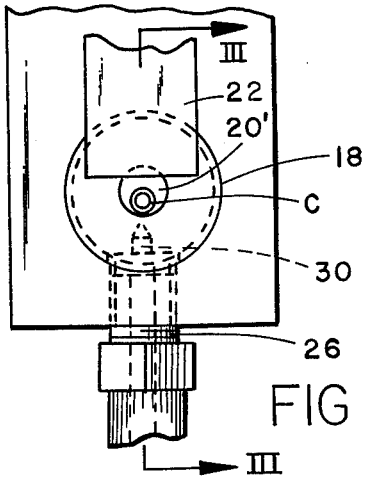
FIG. 4 is an end elevational fragmentary view of the apparatus in FIG. 3 viewed from the right.
Figure 5:
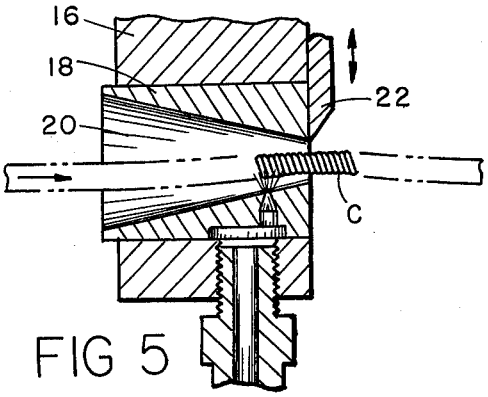
FIG. 5 is a fragmentary plan sectional view of the apparatus in FIG. 3, during the pneumatic indexing function.
Figure 6:
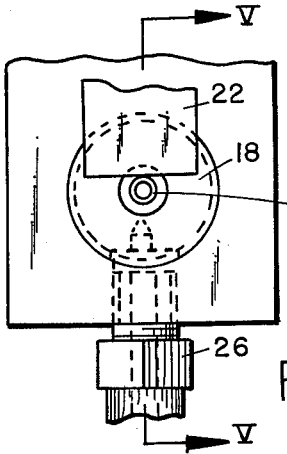
FIG. 6 is an end view of the apparatus in FIG. 5 taken from the right.
Figure 7:
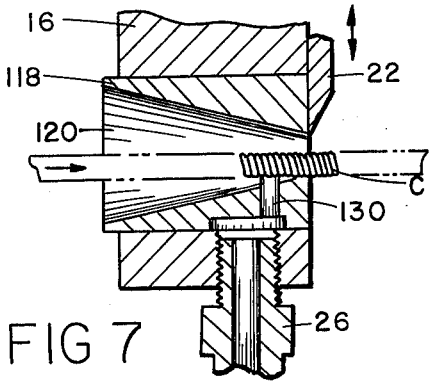
FIG. 7 is a fragmentary sectional plan view of a modified apparatus.
Figure 8:
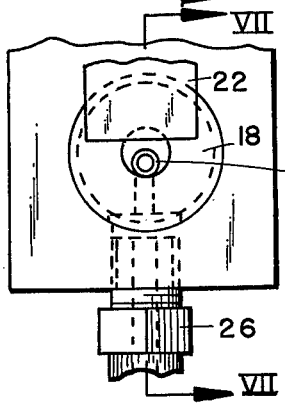
FIG. 8 is an end elevational view of the apparatus in FIG. 7 viewed from the right.
Figure 9:
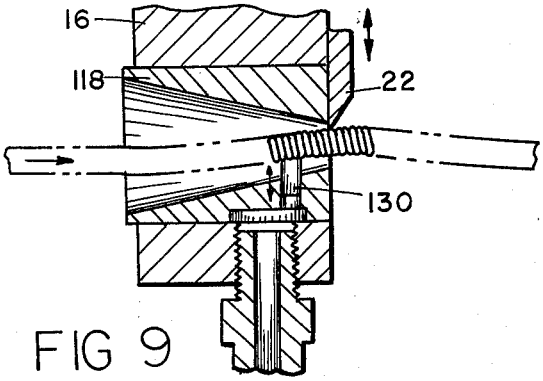
FIG. 9 is a fragmentary plan sectional view of the modified apparatus during the indexing function.
Figure 10:
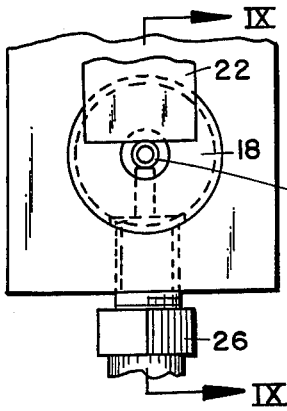
FIG. 10 is an end elevational view of the apparatus in FIG. 9 taken from the right.

This blade 22, retained in a slide guide 24, is mounted on the end of a plunger 26 reciprocably actuable in a forward thrust by attachment to the piston of a fluid cylinder 29. Cylinder 29 is retained between ring 16' and plate 23. The blade and plunger are retractable by a return coil spring 30. Outlet opening 20' of die 18 is larger than the diameter of the coil C to be passing therethrough. The coil advances in the direction indicated by the arrow in FIG. 3 while rotating, typically at rates of about 5,000 rpm.

In FIGS. 3–6 is shown the details of the first form of the novel apparatus. Into the end of housing 16 is a fluid connector 26 attached to a compressed air line 28 to communicate with a passage 30 having a restricted outlet orifice 30'. Orifice 30' projects into the frusto conical die opening 20 near the die outlet 20', on the opposite side of coil C from the blade 22. The orifice is directed toward the coil, i.e. normal to the die passage. The spinning coil will normally tend to approach the side of the die passage opposite the blade. A timer controlled valve (not shown) on conduit 28 enables compressed air to be jetted from outlet 30' against the coil for a very short predetermined time interval of approximately 0.2 seconds, causing coil C to be shifted laterally slightly to cause it to engage the sharp edge of blade 22, i.e so that the blade edge engages the helical groove between the coil turns, thereby indexing the blade with the coil. Then, with the air bias still being applied, the blade is shifted in the opposite direction from the air bias pressure, across opening 20' of die 18, to sever the coil at the wall of the die opposite the blade. By so doing, a predetermined length coil is formed.

In FIGS. 7–10 are shown the details of a modification of the apparatus, employing fluid pressure for the biasing function during indexing and cutoff, but, instead of the air acting directly upon the surface of the coil, it shifts a floating pin or plunger which in turn engages the surface of the coil opposite the cutoff blade to bias the coil into indexing relationship with the blade and retain it in a biased condition during the blade shifting in the opposite direction for cutoff. This is particularly advantageous where the coil is of a stiff wire which does not readily flex or bend under the direct air jet biasing force into indexing relation. It is also advantageous with a coil having an open type construction as opposed to a closed coil, because of the lack of sufficient wire surface area for the air jet to engage due to the spaces between the turns.

This modified apparatus includes the same housing 16, blade 22, and air line connector 26, but a modified die 118 having a pin or plunger 130 slidably engaged in the die in communication with the air inlet line to shift in response thereto. It projects into the frusto conical passage 120 adjacent the outlet end thereof so as to engage the coil C' on the side opposite the blade.

The spinning of the coil, e.g. in a right-hand direction, causes the coil to inherently approach the side of the die passage adjacent this plunger or pin, i.e. opposite the side from blade 22. At a predetermined time, pressure in the passage causes plunger 130 to be slidably shifted axially transverse to the axis of the coil C' into engagement with the coil, biasing the coil to a shifted condition in engagement with the sharp edge of cutoff blade 22 for indexing. Subsequently, after a fraction of a second, e.g. about 0.2 seconds, blade 22 is shifted while biasing pressure is still applied by plunger 130 to keep the coil in engagement with the blade, the shifting blade causing the coil to be severed at the face of the die, followed by retraction of the blade.

Figure 1:
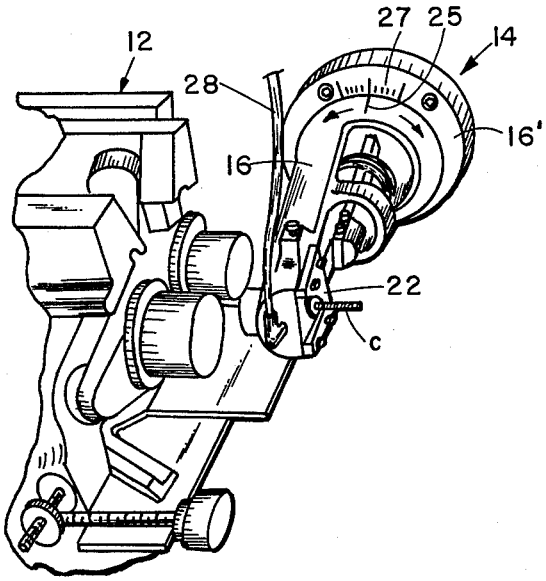
FIG. 1 is a perspective view of the novel apparatus at the discharge end of a wire coiling machine.

Housing 16 is angularly adjustable by reason of the rotational arrangement of its flange in ring 16'. This allows the angle of the cutoff blade to match the angle of the coil helix. This angle is set using indicia which include a mark 25 on housing 16 (FIG. 1, 11, and 12) and a series of cooperative marks 27 on ring 16'. To set the angle of blade 22 and the cooperative flat face of die 18, the housing is first rotated in one arcuate direction until the blade and die face are aligned with the outer readily visible side of the coil (i.e. opposite that side which is actually adjacent the blade) then the angle indicia is noted, and the housing die and blade are rotated the same amount, in the opposite past the zero mark so that the back side of the coil is aligned with the blade.

Figure 11:
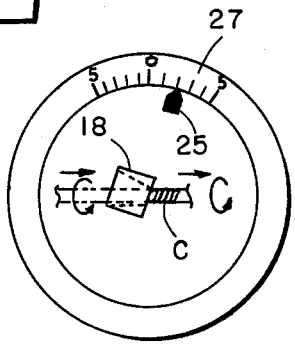
FIG. 11 is a diagrammatic end elevational view showing the pivotal relation of the die and blade with the coil in the first step of alignment of the blade with the coil helix.
Figure 12:
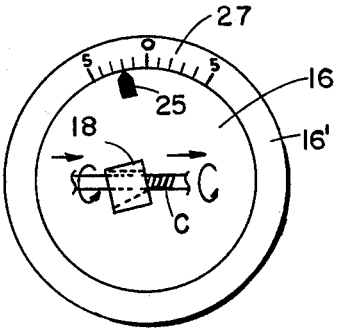
FIG. 12 is a diagrammatic end elevational view like FIG. 11, but in the second step of alignment.

The frusto conically-shaped die orifice enables this shift to occur readily without the die causing bending of the coil, as can be noted from FIGS. 11 and 12.

The novel apparatus has exhibited excellent performance characteristics. It is basically quite simple, once understood, and in fact this is one of its most admirable attributes.

The embodiments of the invention in which an exclusive property or privilege is claimed are defined as follows.

1. A coil cutoff apparatus for severing an axially advancing, rotationally moving wire coil, comprising:

a cutter assembly including a transversely shiftable cutter blade and a coil-restraining die cooperative with said cutter blade, said die having a passage for advancement of a wire coil therethrough, and said cutter blade having an indexing position protruding chordally of said passage;

fluid bias means operable on said wire coil transverse to its direction of axial advancement for momentarily causing indexing engagement between said cutter blade and turns of the rotating, axially-advancing coil;

and a blade actuator for transversely shifting said cutter blade across said die passage to cut off the indexed coil.

2. The coil cutoff apparatus in claim 1 wherein said fluid bias means comprises means for applying a pneumatic pressure differential across the coil transversely of its axial advancement direction to shift the coil into indexing engagement with said blade.

3. The coil cutoff apparatus in claim 1 wherein said fluid bias means comprises means for directing an air jet against the coil in a direction toward said cutter blade.

4. The coil cutoff apparatus in claim 1 wherein said fluid bias means comprises a fluid responsive plunger on the opposite side of the coil axis from said cutter blade and movably transversely of the coil axis toward the cutter blade side thereof for biasing the spinning coil into indexing engagement with said blade and retaining such engagement during cutoff.

5. The apparatus in claim 1 wherein said rotational cutter assembly is angularly movable with respect to the axially advancing coil for alignment with the angle of the coil turns.

6. The apparatus in claim 1 wherein said fluid bias means is operable to maintain the coil in engagement with said blade as said blade shifts to cut off the indexed coil.

7. The apparatus in claim 1 wherein said die has a frusto conically-shaped passage through which the wire coil advances, said passage having a larger diameter inlet and a smaller diameter outlet; said die having a flat face at said outlet, transverse to said outlet; said blade being shiftable on said face across said outlet; said die and blade being movable angularly through an arc to enable said flat face and blade to be aligned with the coil turns.

8. The apparatus in claim 7 including indicia means for indicating the angular position of said die and blade.

9. Coil cutoff assembly for a wire coiling machine which advances the rotationally forming wire coil axially along the coil axis, comprising:

a cutter including a cutter blade, and a die passage for guiding the wire coil and for restraining the wire coil when acted upon by said cutter blade;

said cutter and cutter blade mounted to angularly rotate relative to the forming wire coil;

pneumatic, coil-biasing means for momentarily biasing the coil into engagement with said cutter blade to cause the blade to engage between the turns of the advancing wire coil;

and actuating means for momentarily projecting said cutter blade across said die passage to cut the indexed coil.

10. A coil cutoff apparatus for severing an axially advancing, rotationally moving wire coil, comprising:

a cutter assembly including a transversely shiftable cutter blade and a coil-restraining die cooperative with said cutter blade;

fluid bias means operable on said wire coil for momentarly causing indexing engagement between said cutter blade and turns of the rotating, axially-advancing coil, including a fluid responsive, coil engaging plunger positioned on the opposite side of the die from said blade, and movable transversely of the coil axis to engage and bias the coil into engagement with said blade.

* * * * *

UNITED STATES PATENT AND TRADEMARK OFFICE

CERTIFICATE OF CORRECTION

PATENT NO. : 4,090,425

DATED : May 23, 1978

INVENTOR(S) : Stephen A. Platt

It is certified that error appears in the above-identified patent and that said Letters Patent are hereby corrected as shown below:

Column 4, line 66:

"opposite past" should be ---opposite direction past---

Column 5, line 41:

"movably" should be ---movable---

Signed and Sealed this

*Twenty-third* Day of *January 1979*

[SEAL]

*Attest:*

RUTH C. MASON
*Attesting Officer*

DONALD W. BANNER
*Commissioner of Patents and Trademarks*